United States Patent [19]

Valleau

[11] 4,324,958

[45] Apr. 13, 1982

[54] TACTILE SWITCH DEVICE

[75] Inventor: Robert L. Valleau, Des Plaines, Ill.

[73] Assignee: Switchcraft, Inc., Chicago, Ill.

[21] Appl. No.: 179,189

[22] Filed: Aug. 18, 1980

[51] Int. Cl.[3] ..... H01H 15/02

[52] U.S. Cl. ..... 200/16 F; 200/76

[58] Field of Search ..... 200/11 E, 11 EA, 11 K, 200/16 R, 16 C, 16 D, 16 F, 68, 69, 76, 77, 78, 291

[56] References Cited

U.S. PATENT DOCUMENTS

| | | | |
|---|---|---|---|
| 2,848,584 | 8/1958 | Goudy et al. | 200/291 |
| 3,174,002 | 3/1965 | Golbeck | 200/291 X |
| 3,461,252 | 8/1969 | Vananzi | 200/16 C |
| 3,502,825 | 3/1970 | Bailey et al. | 200/16 D |
| 3,517,140 | 6/1970 | Bailey et al. | |
| 3,651,700 | 3/1972 | Bailey . | |
| 3,843,852 | 10/1974 | Lockard | 200/16 D |
| 3,947,391 | 3/1976 | Lutzenberger | 200/16 F X |
| 4,000,383 | 12/1976 | Lockard | 200/16 D |
| 4,075,442 | 2/1978 | Fukuda et al. | 200/291 X |
| 4,180,712 | 12/1979 | Lutzenberger et al. | 200/16 F X |
| 4,191,867 | 3/1980 | Feaster | 200/291 X |

*Primary Examiner*—David Smith, Jr.
*Assistant Examiner*—J. R. Scott
*Attorney, Agent, or Firm*—John T. Meaney; Joseph D. Pannone; Richard M. Sharkansky

[57] ABSTRACT

A switch device including a base having extended therefrom a bowed spring provided with a peak portion, and a slidable actuator having a cam-shaped surface urged against said peak portion of the spring, the cam-shaped surface having at least one detent portion disposed for releasably engaging said peak portion of the spring to provide a tactile indication of the actuator position relative to said base of the device.

11 Claims, 14 Drawing Figures

TACTILE SWITCH DEVICE

BACKGROUND OF THE INVENTION

1. Field of the Invention

This invention relates generally to switching devices and is concerned more particularly with providing an electrical switch having a slidable actuator with tactile position indicator means.

2. Discussion of the Prior Art

Generally, a switching device includes an actuator for positioning a movable member of the device in desired operative relationship with a fixed member of the device. Thus, a multiposition electrical switch, for example, may be provided with a slidable actuator for positioning one or more movable contact members in electrically connecting relationship with respective fixed contact members at various positions along a fixed base of the switch. Consequently, multi-position electrical switches of the prior art have been provided with means for indicating when the actuators thereof are located in desired positions relative to the bases of the switches. However, these actuator position indicator means of the prior art may be relatively complex and result in a prohibitive increase in the cost of producing the switches.

SUMMARY OF THE INVENTION

Accordingly, these and other disadvantages of the prior art are overcome by this invention which provides an electrical switch having a slidable actuator with relatively simple resilient means for producing a tactile indication of when the actuator is in a desired position. This electrical switch comprises a base having extending therefrom a plurality of fixed contacts which are disposed in spaced relationship with one another, and a bowed spring having a rippled peak portion which extends outwardly beyond the fixed contacts. The switch also includes an actuator slidably disposed on the base and carrying one or more movable contacts into desired positional relationship with one or more of the fixed contacts. The actuator is provided with a slot which receives therein the peak portion of the resilient spring, and has a cam-shaped end surface urged against the peak portion. The cam-shaped end surface includes at least one detent portion which releasably engages the peak portion of the spring to provide a tactile indication of when the actuator is disposed in a desired positional relationship with respect to the base of the switch.

BRIEF DESCRIPTION OF THE DRAWINGS

For a better understanding of this invention, reference is made in the following more detailed description to the drawings wherein.

DESCRIPTION OF THE PREFERRED EMBODIMENT

Figure 1B:
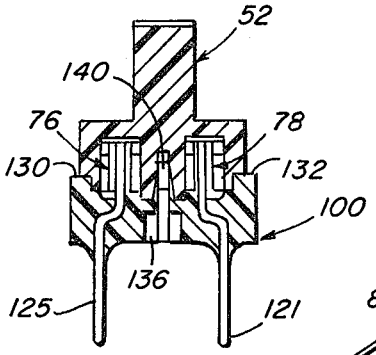
FIG. 1B is a transverse cross-sectional view of the switch shown in FIG. 1 partly assembled.
Figure 1A:
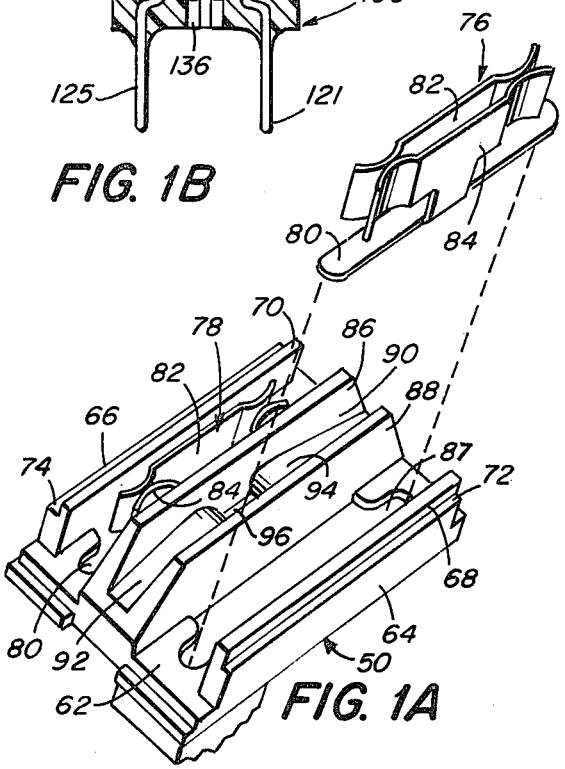
FIG. 1A is an exploded isometric view of the slidable actuator shown in FIG. 1 inverted to show the lower surface thereof.
Figure 1C:
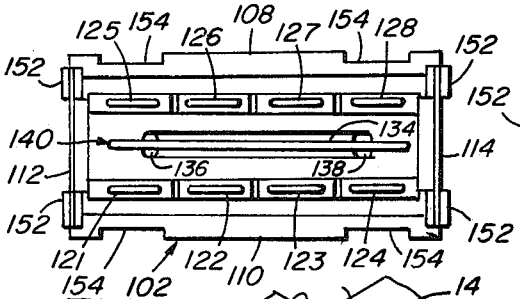
FIG. 1C is a top plan view of the base shown in FIG. 1 but having the spring assembled thereto.
Figure 1D:
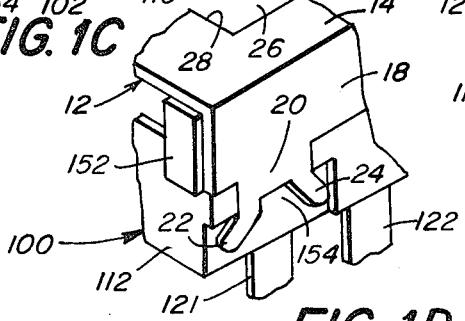
FIG. 1D is a fragmentary view of the assembled switch shown in FIG. 1C and illustrating one method of assembly.
Figure 1:
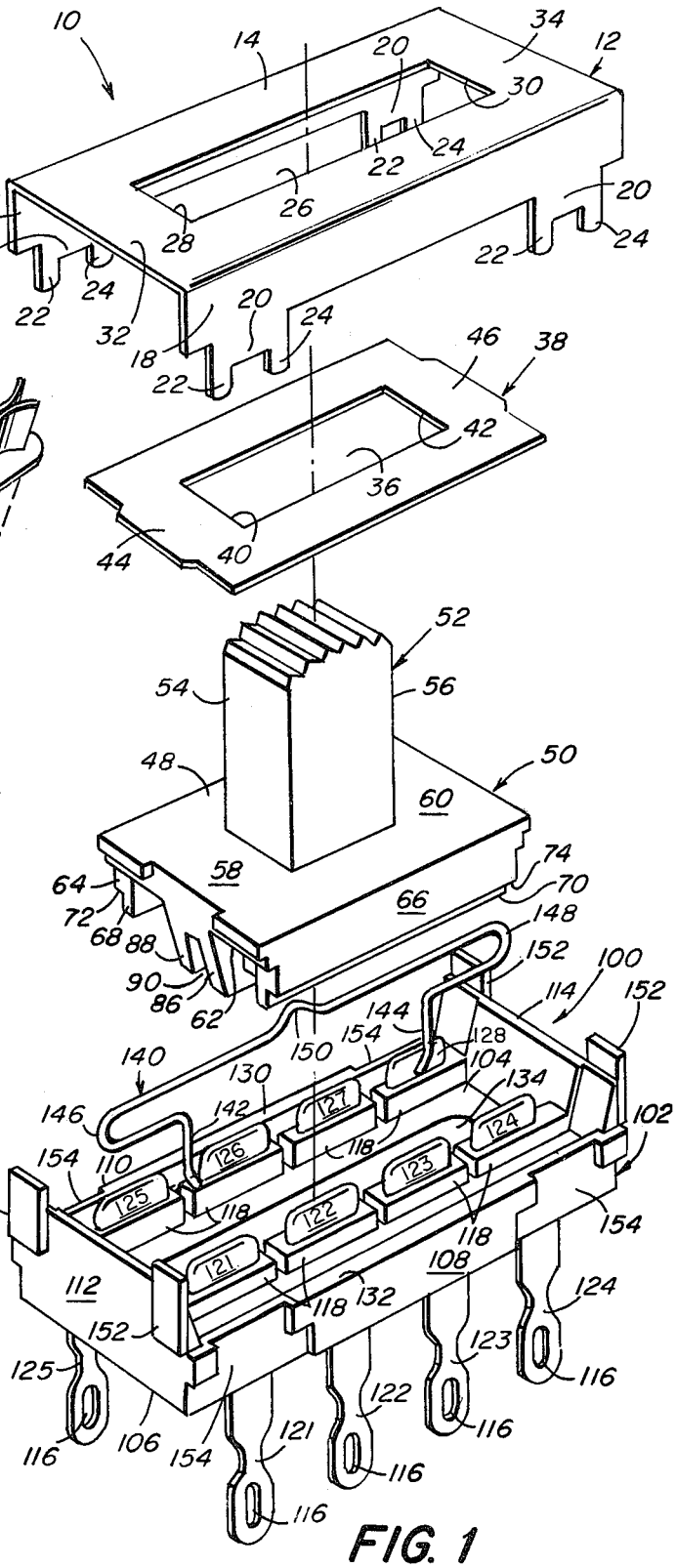
FIG. 1 is an exploded isometric view of a three position switch embodying the invention.

Referring to the drawings wherein like characters of reference designate like parts, there is shown in FIG. 1 a three-position electrical switch 10 including a cover plate 12 made of suitable rigid sheet metal material, such as aluminum, for example. Cover plate 12 may have an inverted U-shaped configuration comprising a rectangular upper wall 14 integrally joined to longitudinal side walls, 16 and 18, respectively. The side walls 16 and 18 have respective opposing end portions provided with depending tabs 20, each of which terminates in a pair of extension fingers, 22 and 24, respectively. Although not shown, it is to be understood that the cover plate 12 may be provided with suitable flange means for mounting the switch 10 in a well-known manner.

Symmetrically disposed in the upper wall 14 of cover plate 12 is a rectangular aperture 26 having respective transverse ends 28 and 30 which define, in conjunction with respective adjacent ends of wall 14, interposed end portions 32 and 34 of wall 14. Aperture 26 in wall 14 is axially aligned with a similarly configured aperture 36 disposed symmetrically in a rectangular shield 38 underlying the wall 14. The shield 38 is made of substantially smooth sheet material, such as plastic, for example, and has a suitable width dimension for fitting slidably between the longitudinal side walls 16 and 18, respectively, of cover plate 12. Aperture 36 in shield 38 has a width dimension substantially equal to the width dimension of aperture 26 and has respective transverse ends 40 and 42. The transverse ends 40 and 42, in conjunction with adjacent transverse ends of shield 38, define respective interposed end portions 44 and 46 of shield 38. For dust shielding purposes, the length of aperture 36 in shield 38 preferably is substantially less than the length of aperture 26 in cover plate 12. Thus, the aperture 36 may have a length which is about one-third less than the length of aperture 26, for example; and the shield 38 may have an overall length which is correspondingly less than the length of cover plate 12.

Underlying the shield 38 is a substantially flat upper surface 48 of a slidable block-like actuator 50 which is made of dielectric material, such as moldable plastic, for example. The actuator 50 includes a quadrihedral knob 52 having one end integrally joined to a mid-portion of the surface 48 and extending slidably through the axially aligned apertures 26 and 36 in cover plate 12 and shield 38, respectively. Knob 52 preferably has a width dimension suitable for slidably engaging the longitudinal edge portions of respective apertures 26 and 36, and has a length dimension which is approximately one-third of the length of aperture 26. Respective transverse surfaces 54 and 56 of the knob 52, in conjunction with adjacent ends of surface 48, define respective interposed end portions 58 and 60 of actuator 50. Each of the end portions 58 and 60 may have a length which is approximately one-third the length of aperture 26.

Figure 2C:
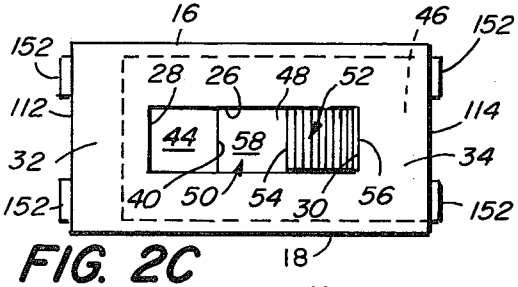
FIGS. 2A–2C are respective top plan views of the assembled switch shown in FIG. 1 to depict the three operational positions of the actuator.
Figure 2B:
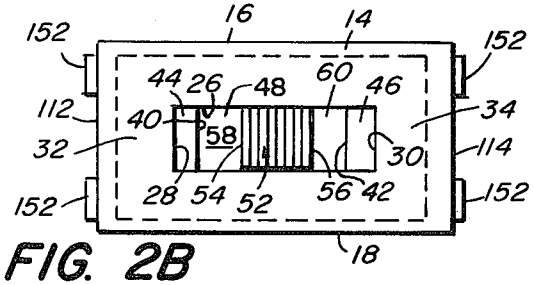
Figure 2A:
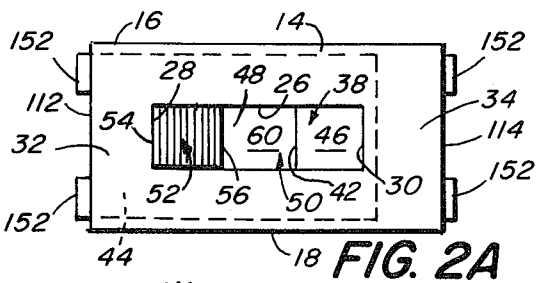

Accordingly, when the knob 52 is centrally disposed in the aperture 26, as shown in FIG. 2B, the opposing transverse ends of surface 48 are disposed adjacent respective ends 28 and 30 of aperture 26. When the knob 52 is moved slidable along aperture 26 to dispose transverse surface 54 of the knob adjacent the transverse end 28 of aperture 26, the surface 54 encounters the transverse end 40 of aperture 36 in shield 38, which then is moved slidably along with further movement of knob 52. As a result, when the surface 54 of knob 52 is disposed adjacent transverse end 28, as shown in FIG. 2A, the adjacent end portions 44 and 58 of shield 38 and actuator surface 48, respectively, underlie the end portion 32 of upper wall 14. Also, the opposing end portion 46 of shield 38 is pulled out from under the end portion 34 of upper wall 14 to cover the resulting space between the transverse opposing end of actuator surface 48 and the adjacent end 30 of aperture 26. Similarly, when the knob 52 is moved slidably in the opposing direction along aperture 26 to dispose the opposing surface 56 of the knob adjacent transverse end 30 of the aperture 26, as shown in FIG. 2C, the end portions 46 and 60 of shield 38 and actuator surface 48, respectively, are disposed under the end portion 34 of cover plate 12. Also, the opposing end portion 44 of shield 38 is pulled by the knob 52 out from under the end portion 32 of cover plate 12 to cover the space between the adjacent end of actuator surface 48 and the transverse end 28 of aperture 26. Thus, FIGS. 2A–2C depict the three operative positions, as seen externally, of the three-position switch 10.

As shown in FIG. 1A, the block-like actuator 50 is provided with a lower surface 62 having opposed marginal portions integrally joined to depending longitudinal side walls, 64 and 66, respectively. Each of the side walls 64 and 66 has a respective distal end portion 68 and 70 of reduced thickness which provides an outer shoulder surface, 72 and 74, respectively. The shoulder surfaces 72 and 74 function as respective runners for slidably supporting the block-like actuator 50. Disposed adjacent the inner surfaces of side walls 64 and 66 are respective movable contacts 76 and 78 which are made of resilient, electrically conductive material, such as phosphor bronze, for example. Each of the movable contacts 76 and 78 comprises an oblong support strip 80 having attached to opposing longitudinal edge portions thereof respective contact strips 82 and 84 which are disposed in juxtaposed relationship with one another. Preferably, the contact strips 82 and 84 have respective opposing end portions which are arcuately curved toward one another to exert opposing pressures against an interposed fixed contacts. The support strips 80 of the respective movable contacts 76 and 78 are secured, as by press-fitting or bonding, for example, in conformingly shaped recesses 86 in the surface 62 of actuator 50.

Disposed between the movable contacts 76 and 78 is a spaced pair of ridges 86 and 88, respectively, which define an interposed longitudinally extending slot 90. The slot 90 has a cam-shaped inner end surface comprising two arcuately curved, wave-like portions 92 and 94 separated by a central trough-like portion 96. Each of the wave-like portions 92 and 94 curves sharply from the central trough-like portion 96 to a respective crest and then slopes gradually therefrom toward surface 62 as a function of distance from the adjacent transverse end of actuator 50. The trough-like portion 96 is provided with sufficient depth relative to the adjacent crests of respective wave-like portions 92 and 94 to function as a detent means.

The lower surface 62 of actuator 50, as shown in FIG. 1, overlies a base 100 comprising a rectangular support platform 102 having an upper surface 104 and an opposing lower surface 106. Platform 102 also includes an integral pair of longitudinal side walls 108 and 110, respectively, and an integral pair of transverse end walls 112 and 114, respectively, all of which extend above the upper surface 104 of platform 102. The platform 102 is made of dielectric material, such as moldable plastic for example, and has extended through it a plurality of mutually spaced terminals 121–128, respectively. The terminals 121–128 may have conventionally configured end portions depending from the lower surface 106 of platform 102 and provided with respective apertures 116 for soldering electrical wires (not shown) thereto, if desired. Terminals 121–128 are made of electrically conductive material, such as silver plated brass, for example, and are sealed by conventional means, such as molding, for example, in the material of platform 102. The terminals 121–128 have respective blade-like end portions protruding upwardly from respective encircling molded bosses 118 on the upper surface 104 of platform 102. The blade-like upper end portions of terminals 121–124 are disposed in a row adjacent side wall 108 of platform 102; and the blade-like upper end portions of terminals 125–128 are disposed in a row adjacent the opposing side wall 110. Also, the blade-like upper end portions of terminals 121–128, respectively, extend above the longitudinal side walls 108 and 110, but do not extend above the transverse end walls 112 and 114 of platform 102. 102.

The side walls 108 and 110 of platform 102 have respective upper surfaces 130 and 132 which constitute bearing surfaces along which the shoulder surfaces 72 and 74, respectively, slide when the knob 52 is moved as described in connection with FIGS. 2A–2C. Accordingly, as shown in FIG. 1B when the block-like actuator 50 is assembled to base 100, the respective distal end portions 68 and 70 of side walls 64 and 66 of actuator 50 fit slidably within the respective side walls 108 and 110 of platform 102 to bring the shoulder surfaces 72 and 74 into slidable engagement with the upper surfaces 130 and 132 of side walls 108 and 110, respectively, of platform 102. Also, each of the movable contacts 76 and 78 is brought into slidable contacting relationship with the blade-like upper end portions of terminals 121–124 and 125–128, respectively.

Figure 3C:
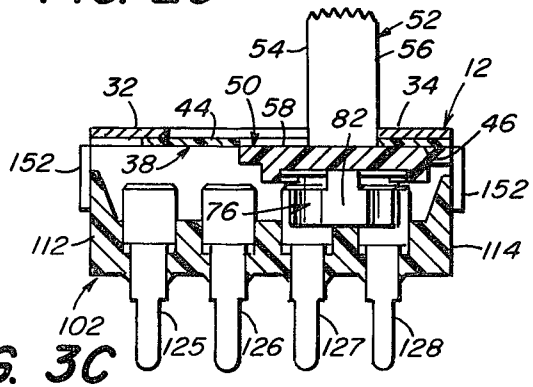
FIGS. 3A–3C are respective axial sectional views of the actuator assembled to the base to depict the three operational positions thereof corresponding to FIGS. 2A–2C, respectively.
Figure 3B:
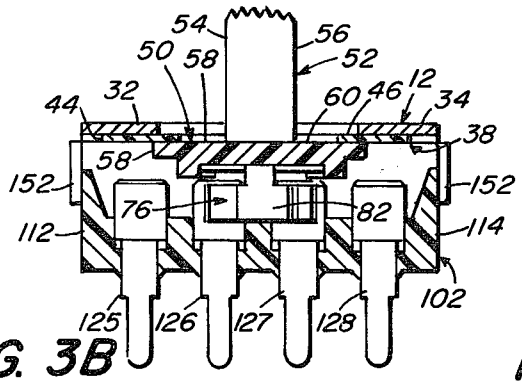
Figure 3A:
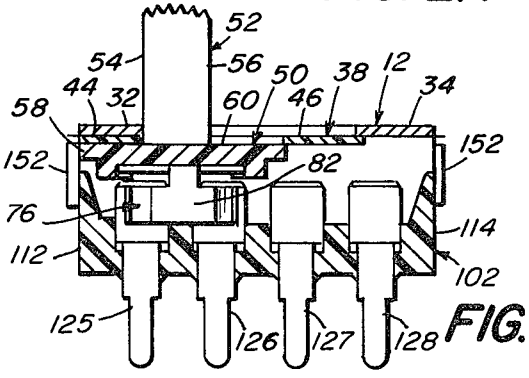

Thus, as shown in FIGS. 3A–3C, when the knob 52 is moved slidably along the aperture 23 to locate the surface 54 adjacent the transverse end 28 of aperture 26, as described, the movable contact 76 is slidably disposed to connect the terminal 125 to the terminal 126; and the movable contact 78 is slidably disposed to electrically connect the terminal 121 to the terminal 122. Similarly, when the knob 52 is centrally located in the aperture 23, the movable contacts 76 and 78 are disposed to connect the terminal 126 to the terminal 127 and the terminal 122 to the terminal 123, respectively. Also, when the knob 52 is moved slidably along aperture 26 to locate the surface 56 of knob 52 adjacent the transverse end 30 of aperture 26, as described, the movable contact 76 is slidably disposed to connect the terminal 127 to the terminal 128; and the movable contact 78 is slidably disposed to connect the terminal 123 to the terminal 124.

Accordingly, the three internal positions of the switch 10 shown in FIGS. 3A-3C correspond to the three external positions of the switch 10 shown in FIGS. 2A-2C. The external positions shown in FIGS. 2A and 2C and corresponding to the internal positions shown in FIGS. 3A and 3C, respectively, are relatively easy to locate because of the knob 52 being disposed adjacent respective transverse ends 28 and 30 of the aperture 26. However, the external position shown in FIG. 2B and corresponding to the internal position shown in FIG. 3B requires an indicator means for signalling the operator when this position is reached.

Figure 6:
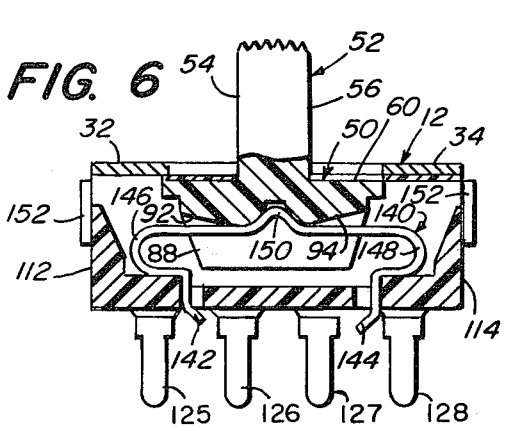
FIG. 6 is an axial sectional view of the assembled switch illustrating the operation of the tactile indicator when the actuator is disposed as shown in FIGS. 2B and 3B.
Figure 5:
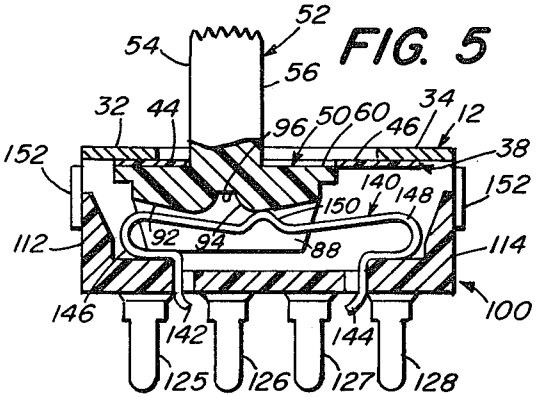
FIG. 5 is an axial sectional view of the assembled switch illustrating the operation of the tactile indicator when the actuator is moved toward the position shown in FIGS. 2B and 3B.
Figure 4:
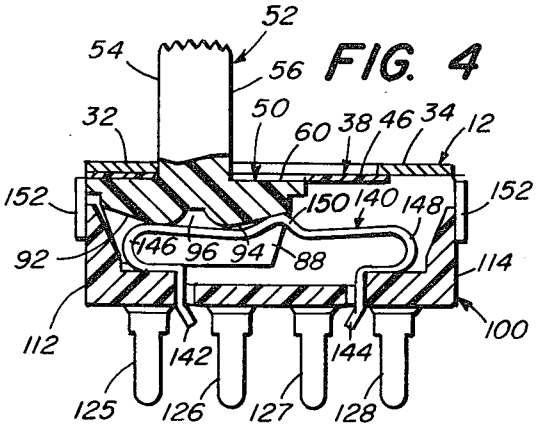
FIG. 4 is an axial sectional view of the assembled switch illustrating the operation of the tactile indicator when the actuator is disposed as shown in FIGS. 2A and 3A or FIGS. 2C and 3C.

Referring to FIGS. 1 and 1C, it may be seen that the upper surface 104 of platform 102 has centrally disposed therein a longitudinally extending recess 134 wherein a pair of longitudinally spaced apertures 136 and 138, respectively, are disposed to extend through the platform 102. Assembled in each of the apertures 136 and 138 is a respective terminal end portion 142 and 144 of a bow spring 140 which is made of suitable resilient material, such as cold drawn steel, for example. The terminal end portions 142 and 144, as shown in FIGS. 4-6, are bent to lock resiliently against defining wall portion the apertures 136 and 138, respectively, and form respective intermediate loop portions 146 and 148, which extend from the upper surface 104 of platform 102 and into the slot 90 of actuator 50. The intermediate loop portions 146 and 148 merge to form a central rippled peak 150 which is resiliently urged against the cam-shaped closed end surface of slot 90. The shield 38 is disposed in overlying relationship with the upper surface of 48 of actuator 50, and the cover plate 12 pressed downwardly over the shield 38, as shown in FIG. 1D.

Each of the transverse end walls 112 and 114 has opposing upper corner portions provided with respective upwardly extending tabs 152 which support the upper wall 14 of cover plate 12 in predetermined overlying relationship with the upper surface 48 of actuator 50. Also, the outer surfaces of each of the side walls 108 and 110 have disposed in opposing end portions thereof respective stepped recesses 154 wherein the depending tabs 20 protrude, as shown in FIG. 1D, and have the extension fingers 22 and 24 spread laterally to lock the cover plate 12 in place. Thus, the cover plate 12 maintains the cam-shaped end surface of slot 90 in pressure engagement with the peak 150 of bow spring 140. Consequently, when the surface 54 of knob 52 is disposed adjacent the transverse end 28 of aperture 26, the peak 150 of spring 140 is urged against the gradual slope portion of wave-like portion 94 of the cam-shaped end surface. As a result, the peak 150 of spring 140 exerts a component pressure force laterally to aid in holding the surface 54 of knob 52 adjacent the transverse end 28 of aperture 26, as shown in FIG. 4. Consequently, the pressure exerted by the peak 150 of spring 140 on the gradual slope of wave-like portion 94 aids in holding the movable contacts 78 and 76, as shown in FIG. 3A, in electrically conductive relationship with terminals 121-122 and 125-126, respectively.

When the surface 54 of knob 52 is moved slidably away from the transverse end 28 of aperture 26, the wave-like portion 94 of the cam-shaped end surface of slot 90 slides relative to the peak 150 of spring 140 and causes compression of spring 140 between the intermediate loop portions 146 and 148, respectively, as shown in FIG. 5. Consequently, when the knob 52 is centrally disposed in the aperture 26, as shown in FIG. 2B, the peak 150 of spring 140 snaps into the troughlike detent portion 96 of the cam-shaped end surface of slot 90, as shown in FIG. 6. Thus, the bow spring 140, in cooperation with the detent portion 96 of cam-shaped end surface of slot 90, provides a tactile indication of the actuator 50 being slidably located, with respect to the base 100, for electrically connecting the terminal 122 to the terminal 123 through movable contact 78, and the terminal 126 to the terminal 127 through movable contact 76, as shown in FIG. 3B. Accordingly, the peak 150 of spring 140 and the detent portion 96 of the cam-shaped end surface of slot 90 constitute respective position indicia which cooperate with one another to locate the actuator 50 in a desired position relative to the base 100.

Similarly, as shown in FIG. 5, the actuator may be released from the position shown in FIG. 6 by the crest of wave-like portion 92 exerting a pressure against the peak 150 of spring 140 to compress the spring between the intermediate loop portions 146 and 148 thereof. Then, the actuator 50 may be moved slidably to locate the transverse surface 56 of knob 52 adjacent the opposing transverse end 30 of aperture 26, as shown in FIG. 2C. The resulting pressure exerted by the peak 150 of spring 140 on the gradual slope of wave-like portion 92 has a laterally directed component which aids in sliding the block-like actuator 50 in the desired direction. Also, as previously described, the laterally directed component of the pressure exerted by the peak 150 on the gradual slope of wave-like surface 92 aids in holding the actuator 50 in the position shown in FIG. 2C to maintain the electrical connections depicted in FIG. 3C. Thus, it may be seen that the defining wall surfaces of slot 90 function as a guide channel for restraining the peak 150 of spring 140 from moving laterally while the cam-shaped end surface of the slot is moving longitudinally over the peak portion of spring 140.

Alternatively, the terminal 122 may be permanently connected to the terminal 123 and the terminal 126 may be similarly connected to the terminal 127, either externally or internally of switch 10, as by respective interconnecting conductors, for example, to provide a double pole-double throw switch. Consequently, this double pole switch would be thrown in one direction when disposed as shown in FIGS. 2A and 3A, respectively, and would be thrown in the other direction when disposed as shown in FIG. 2C and 3C, respectively. Accordingly, the position of switch 10 shown in FIGS. 2B and 3B illustrates the described double pole-double throw switch in an equivalent "OFF" position which is important to locate, particularly in times of emergency. Also, it is important to maintain the double pole-double throw switch in the "OFF" position when working on associated electrical equipment. Therefore, this invention provides a bow spring having a peak portion disposed for releaseable engagement with a trough-like detent portion in a wave-like, cam-shaped surface to locate the switch actuator readily in a selectable position and to maintain the switch actuator in the selectable position until release of the actuator is desired.

Best Available Copy

From the foregoing, it will be apparent that all of the objectives of this invention have been achieved by the structures shown and described herein. It also will be apparent, however, that various changes may be made by those skilled in the art without departing from the spirit of the invention as expressed in the appended claims. It is to be understood, therefore, that all matter shown and described herein is to be interpreted as illustrative and not in a limiting sense.

What is claimed is:

1. An electrical switch device comprising:

a base;

electrical conductor means insulatingly secured to said base and extended therefrom;

actuator means supported for relative movement with respect to said base and having electrical contact means disposed for electrical engagement with said electrical conductor means, the actuator means including an elongated channel disposed in the direction of said relative movement and having a detent portion; and spring means coupled to said base and having a compressible portion extended into said channel for releaseably engaging said detent portion and providing tactile indication of the position of the electrical conductor relative to the position of the electrical contact means, the compressible portion including a pair of opposing reentrant loops disposed between said base and said actuator means for enhancing the compressive resiliency of said spring means.

2. An electrical switch device as set forth in claim 1 wherein said channel has a cam-shaped surface including said detent portion and said compressible portion of the spring means includes a peak disposed between said pair of opposing reentrant loops and in pressure engagement with said cam-shaped surface.

3. An electrical switch device as set forth in claim 2 wherein said cam-shaped surface comprises two successive wave-like surface portions and said detent portion comprises a trough-like depression between said two wave-like surface portions.

4. An electrical switch device comprising:

a base having a first surface;

electrical conductor means secured to said base and extended from said first surface;

spring means including a wire having terminal end portions anchored to said base and having a compressible portion extended in a plane from said first surface of the base;

actuator means having a second surface disposed adjacent said first surface of the base and supported for relative movement with respect to said base, the actuator means including electrical contact means secured to said second surface of the actuator means for electrical engagement with said electrical conductor means and including guide channel means disposed for receiving therein said compressible portion of the spring means.

5. An electrical switch device as set forth in claim 4 wherein said guide channel means includes a cam-shaped surface disposed for pressure engagement with said compressible portion of said spring means.

6. An electrical switch device as set forth in claim 5 wherein said compressible portion of the spring means includes a pair of opposing loop portions disposed between said respective surfaces of the base and the actuator means for resiliently resisting compressive pressure exerted on the spring means by said cam-shaped surface of the channel means.

7. An electrical switch device as set forth in claim 6 wherein said compressible portion of the spring means includes a peak portion disposed between said opposing loop portions of the spring means and in resilient pressure engagement with said cam-shaped surface of the channel means.

8. An electrical switch device as set forth in claim 7 wherein said cam-shaped surface includes a detent portion disposed for releaseably engaging said peak portion of the spring means to provide a tactile indication of said contact means electrically engaging said electrical conductor.

9. An electrical switch device as set forth in claim 8 wherein said cam-shaped surface comprises at least two successive wave-like surface portion and said detent portion comprises a trough-like surface portion disposed between said two successive wavelike surface portions.

10. An electrical switch device comprising:

an elongated dielectric base;

a plurality of electrical conductors spaced along an axis of said base said electrical conductors having first end portions protruding from said base for external electrical connection and having second end portions;

an elongated spring secured to the base and having a position indicium disposed at a predetermined position thereof, said position indicium being integrally formed between a pair of opposing reentrant loop portions of said spring extended along said base a predetermined distance;

an actuator slidably disposed relative to said base and having a dimension along said base less than said predetermined distance, said actuator having electrical contact means disposed for engaging said second end portions of a pair of said electrical conductors selected in accordance with the position of the actuator relative to the base and having a channel portion disposed for receiving therein said elongated spring, the channel portion having detent means for engaging said indicium of said spring at said predetermined position and for providing tactile indication of said contact means engaging said selected pair of the conductors.

11. An electrical switch comprising:

a dielectric base having a surface;

actuator means having a predetermined dimension extended along said surface and disposed for sliding along said surface of the base, said actuator means including electrical contact means and a first indicium portion;

electrical conductor means including a first end portion extended from said base for external dielectrical connection and a second end portion disposed for electrical engagement with said electrical contact means; and elongated spring position indicator means coupled to the base and extended along said base between said surface of the base and the actuator means for a distance greater than said predetermined dimension of actuator means said spring position indicator means having a pair of opposing reentrant loop portions supporting an interposed second position indicium means above a predetermined position of said base for engagement with said first position indicium portion and providing a tactile indication of the relative position of said second end portion of the electrical conductor means with respect to the electrical contact means.

* * * * *

UNITED STATES PATENT OFFICE

CERTIFICATE OF CORRECTION

Patent No. 4,324,958 Dated April 13, 1982

Inventor(s) Robert L. Valleau

It is certified that error appears in the above-identified patent and that said Letters Patent are hereby corrected as shown below:

Col. 8, lines 52 and 53, "dielectrical" should be

-- electrical --

Signed and Sealed this

*Twenty-seventh* Day of *July 1982*

[SEAL]

*Attest:*

GERALD J. MOSSINGHOFF

*Attesting Officer*

*Commissioner of Patents and Trademarks*